US005660631A

United States Patent [19]

Eriksson

[11] Patent Number: 5,660,631

[45] Date of Patent: Aug. 26, 1997

[54] RENEWABLE FLEXIBLE BAND DOCTORING DEVICE

[75] Inventor: Tore Eriksson, Klässbol, Sweden

[73] Assignee: BTG Kalle Inventing AB, Saffle, Sweden

[21] Appl. No.: 553,688

[22] PCT Filed: Jun. 15, 1994

[86] PCT No.: PCT/SE94/00588

§ 371 Date: Dec. 11, 1995

§ 102(e) Date: Dec. 11, 1995

[87] PCT Pub. No.: WO95/00256

PCT Pub. Date: Jan. 5, 1995

[30] Foreign Application Priority Data

Jun. 18, 1993 [SE] Sweden ..... 9302127

[51] Int. Cl.[6] ..... B05C 1/00

[52] U.S. Cl. ..... 118/106; 118/118; 118/126; 118/257; 118/262; 118/413

[58] Field of Search ..... 118/106, 118, 118/126, 227, 257, 261, 262, 413

[56] References Cited

U.S. PATENT DOCUMENTS

| | | | |
|---|---|---|---|
| 3,182,632 | 5/1965 | Vazdikis | 118/106 |
| 4,869,933 | 9/1989 | Sollinger et al. . | |
| 4,880,672 | 11/1989 | Eriksson . | |
| 5,031,569 | 7/1991 | Eriksson . | |
| 5,048,453 | 9/1991 | Eriksson . | |
| 5,133,281 | 7/1992 | Eriksson . | |
| 5,264,035 | 11/1993 | Beisswanger et al. | 118/126 |

FOREIGN PATENT DOCUMENTS

| | | |
|---|---|---|
| 3735889 | 2/1994 | Germany . |
| 463078 | 10/1990 | Sweden . |
| 468344 | 12/1992 | Sweden . |
| 856580 | 8/1981 | U.S.S.R. . |
| WO93/03859 | 3/1993 | WIPO . |
| WO93/05887 | 4/1993 | WIPO . |

*Primary Examiner*—Laura Edwards

*Attorney, Agent, or Firm*—Burns, Doane, Swecker & Mathis, L.L.P.

[57] ABSTRACT

A coating device for one- or two-sided coating of a travelling web includes at least one counter-device and at least one first metering device placed on the opposite side of the web (5) for applying onto said web, in cooperation with said counter-device, a coating agent. The metering device (7) includes an evening or metering member (11) extending across the web over its full width. The evening or metering member is made of a flexible, elongate element (21, 23), the length of said element (21, 23) substantially exceeding the width of the web (5) and being arranged to be fed across the web (5) so that new sections of the element will come into contact with the web to ensure correct evening or metering of the supplied coating agent. The coating device according to the invention can be used for transfer coating as well as direct coating.

19 Claims, 2 Drawing Sheets

RENEWABLE FLEXIBLE BAND DOCTORING DEVICE

The present invention relates to a coating device for one- or two-sided coating of a travelling web, preferably a paper web. The invention comprises both the techniques of so called transfer coating using a transfer roller and a direct coating where the metering means works directly on the travelling web.

Even if the invention is not restricted hereto it will in the following be illustrated mainly in connection with so called transfer coating.

Transfer coating means a process where the coating agent, i.e. a coating paste, coating liquid or size, is metered onto a conveyor roller, so called transfer roller, whereby on engagement of the roller on the travelling web the coating agent is applied to same. For using these techniques several devices are known which essentially operate according to three different metering principles.

According to the first principle the metering takes place volumetrically, i.e. the metering means is provided on the surface thereof with parallel grooves or splines. The highest points of the metering means are thus in direct contact with the transfer roller, and thereby volumetric metering takes place by the presence of the coating agent in the interstices between the contact surfaces. On its way to and at the contact transfer site the metered material flows together and forms a fully covering layer of even thickness on the travelling web. An example of techniques based on this principle are described in Swedish patent 8803403-8. The process results in a uniformly metered quantity with small variations of applied amount seen in longitudinal as well as cross-wise of the paper web. However, the techniques are associated with two essential drawbacks.

One drawback resides in the fact that the groove pattern will be gradually worn down, which results in gradual change of the metered amount of coating agent, and in addition replacement of metering means, in this case a roller, involves large expenditures by interrupted production and in connection with recreation of the roller surface for reestablishment of the correct dosage.

The other drawback occurs when applying small quantities of coating agent of high viscosity and at high speed. In view of the fact this prior art uses a metering means in the form of a self-supporting roller the diameter of the roller is considerable in view of the requirement for bending resistance. For volumetric metering of small quantities it is also required to have a very delicate pattern on the surface of the metering roller. At high web speeds this design of the metering roller results in an effect that can be similar to aqua planing. In spite of a high engagement pressure with the metering roller there is risk that the contact between the highest points of the metering roller and the transfer roller is lost which results in uncontrolled dosing.

In the other metering principle the dosing means is constituted by a rotary rod of a small diameter. Differently from the principle first described this rod is not self-supporting but is journalled in a journal fixture extending across the travelling web. An example of this principle is found in DE OS A1 3735889. Also these techniques are associated with drawbacks. One drawback is that the rod by its small diameter is worn down quite quickly. Furthermore, the elongate mounting of the rod is worn down which, in addition to costs for lost production, also results in a risk for admixture of lubricating liquid in the coating agent in view of the fact that the mount has longitudinal channels for lubricating the rod with for example water.

In the third principle for metered coating there is used instead of volumetric metering so called hydrodynamic metering. The device for applying this principle is designed in the same manner as devices used in the previously described principles but the grooved rod is replaced by a smooth rod or a flexible steel blade. The wear problems may largely be eliminated by using this principle in view of the fact that a smooth rod can be easily supplied with a surface layer resistant to wear. Furthermore, the engagement pressure per surface unit will be lower in view of the fact that the metering means engages the transfer roller with all of its surface in the area of engagement.

The problem when using this hydrodynamic method is the difficulty of metering a layer of even thickness as seen longitudinally and cross-wise of the web since the principle is based on controlled aqua planing differently from the volumetric principle where the metering means engages the transfer roller.

The present invention has for its purpose to provide a coating device by means of which the prior art disadvantages are eliminated or at any rate essentially reduced by maintaining an even coating.

Another object of the invention is to provide a coating device which through reliable operation results in lower costs by reduced loss of production and where the metering means proper fetches a lower cost.

Yet another object of the invention is to provide a coating device for one- or two-sided coating of a travelling web, where the coating either is so called transfer coating or is constituted by direct coating where the metering means operates in direct engagement with the travelling web.

For these and other objects which will be clear from the following disclosure there is provided through the present invention a coating device for one- or two-sided coating of a travelling web, preferably a paper web, and the device comprises at least one counter-means and at least one first metering means placed on the opposite side of the web for applying onto said web, in cooperation with said counter-means, a coating agent, for example in the form of size or coating paste. The coating device is characterized in that the metering means comprises an evening or metering member extending across the web over its full width and which is made of a flexible, elongate element, the length of said element substantially exceeding the width of the web and being arranged to be fed across the web so that new sections of the element will come into contact with the web to ensure correct evening or metering of the supplied coating agent.

For so called transfer coating the coating device according to the invention may comprise at least one first transfer roller rotating in contact with the web, and a counter-means or a second transfer roller placed on the opposite side of the web and at least one first metering means to apply onto the web, in cooperation with said first transfer roller, coating agent, and this embodiment of the coating device according to the invention is characterized in that the contact surface of the elongate element engaging the transfer roller is provided with parallel transverse grooves or splines which are supplied with coating agent for volumetric or metered application onto the surface of the transfer roller before its contact with the web.

According to a preferred embodiment of the invention the coating device comprises a fixed supporting means extending across the full width of the web, the elongate element being slidably arranged with engagement onto the web at one longside of said supporting member.

The elongate element suitably comprises a coextensive supporting profiled member and an element engaging the web anchored in a first longitudinal recess arranged in the profiled member.

The profiled member is preferably provided with another longitudinal recess wherein the above-mentioned one longside of the supporting member is accommodated.

Said supporting member is suitably designed as a blade carried by a blade holder along its other longside. The blade holder preferably comprises a fixed jaw and a mobile counter-jaw, and between said jaws the blade being movably clamped. It is particularly preferred that one jaw is provided with a resilient sealing so that both sealing towards the coating agent and movability for the blade are obtained.

In a particular embodiment of the coating device according to the invention pressure means are arranged for bringing from the outside and adjacent to said one longside of the blade the member of the elongate element in engagement on the web. Said pressure means may suitably comprise a pressure blade coextensive with the blade, said pressure blade transversely forming an angle to the blade and being arranged with one longitudinal edge thereof to exert a pressure along said one longside of the blade.

For individual section-wise control of the pressure against said one longside of the blade pressure members are suitably arranged distributed along the pressure blade. It is particularly preferred that the element engaging the web has circular cross-section, and a preferred embodiment with regard to the element engaging the web is a closely wound helix spring which is exposed outwardly to less than half its circumference so as to ensure safe anchorage in said first recess of the profiled member.

The elongate element which constitutes the metering means proper of the coating device according to the present invention can be wound onto a supply roll, from which it can be dewound for feeding across the travelling web. For the purpose of exposing new sections of the element engaging the web it is suitable to arrange means, whereby said element can rotate step-wise or continuously in the anchorage recess of the profiled member.

In one embodiment of the coating device according to the invention intended for direct coating the element engaging the web can be designed-as an elongate thread travelling in the first recess of the profiled member. In this case the profiled member is suitably arranged in a stationary member on the supporting means.

It is particularly preferred to use an element engaging the web in the form of a closely wound spiral spring of small diameter. In the normal case the diameter is from about 2 to 6 mm but may in some cases exceed 6 mm. The supporting means is preferably an extruded plastic profile, and for so called transfer coating the element engaging the web and the profiled member are suitably fed together by means of a suitable motor-operated feeding device. The rate of feeding is adapted so that the wear on the metering member under its passage through the machine across the web will not be so large that the quantity of metered coating agent will change between the inlet side and the outlet side of the metering member.

Several embodiments for the feeding of the metering member are conceivable. Thus, the feeding can be performed in such a manner that the metering member is rapidly fed through the application unit and the output wound onto a storage roll. At the end of the feeding the feeding is reversed so that the supply roll again will be receiver of the metering member. This embodiment can be advantageous when using a high-wearing coating agent requiring a high speed of feeding in order that the difference in wear on the metering member between the inlet side and the outlet side shall not affect the dosage supplied.

The coating device according to the present invention can be designed for two-sided coating of a travelling web, and may for this purpose comprise two cooperating transfer rollers between which the web travels, and two metering devices designed in accordance with the invention and cooperating with its transfer roller. According to an alternative embodiment for such two-sided coating the device may comprise also a transfer roller and a blade coater of a conventional type placed on the opposite side of the transfer roller.

It is known from the techniques where slim metering means are used how the load on the metering member can be arranged so that the pressure across the whole width of the web can be adjusted uniformly by varying the pressure section-wise across the web. Such device for controlling the blade pressure in connection with doctor blade coating is described in Swedish patent application 9102783-9. Similar techniques described in said patent application may be used also for controlling the contact pressure between the metering member and the transfer roller in connection with the present invention.

The feeding device for the metering member can be designed in accordance with conventional techniques. The metering member may thus be contained on a supply roll or in a casett from which the metering member is continually fed across the travelling web. The device for the feeding may consist of feeding pulleys driven by for example an electric motor. The feeding speed preferably lies within the range about 0.2 to about 2 m per hour but may in particular cases amount to about 5 m per hour or more.

The invention will in the following be further illustrated by non-limiting examples with reference to the pended drawings, wherein.

Figure 1:
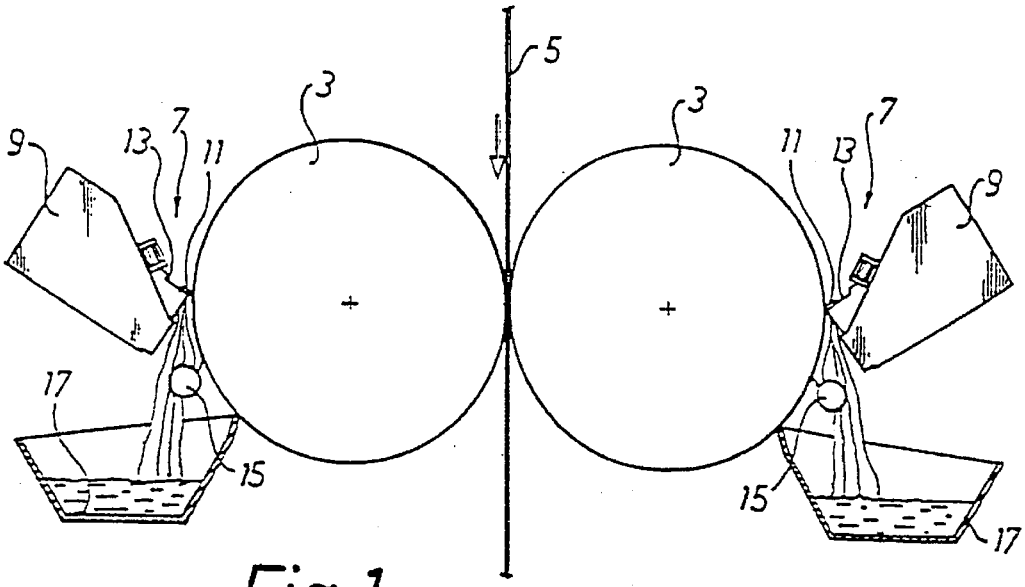
FIG. 1 shows diagramatically a coating device according to the present invention with a downwardly travelling web.

The coating device designed in accordance with the present invention and diagramatically shown in FIG. 1 in a side-view is intended for so called transfer coating. The device comprises a pair of transfer rollers 3, between which the paper web 5 travels in a downward direction. A metering device 7 cooperates with each transfer roller 3, and said metering device 7 consists in principle of a supporting beam 9, a metering means 11 and an engagement means 13. Coating liquid or paste is applied through an application conduit 15 and excess thereof is collected in a chute 17.

Figure 2:
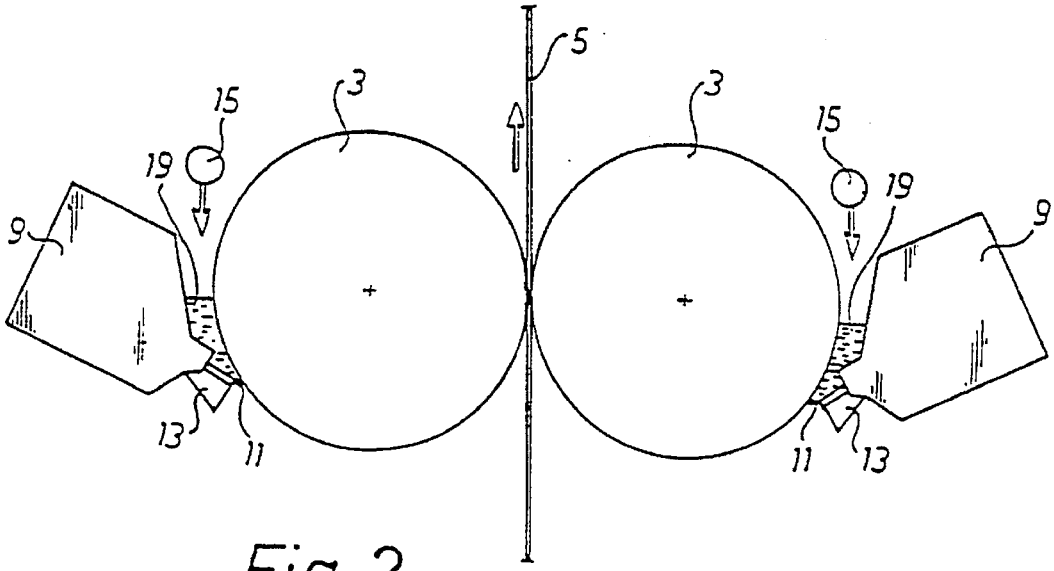
FIG. 2 shows diagramatically a coating device according to the invention with a web travelling upwardly.

The device shown diagramatically in FIG. 2 corresponds to that in FIG. 1 shown except for the fact that the paper web 5 in this case travels upwardly between the transfer rollers 3. The metering devices are turned upside down and the coating liquid is supplied through application conduits 15, and in this case ponds 19 of coating liquid are formed.

Figure 3:
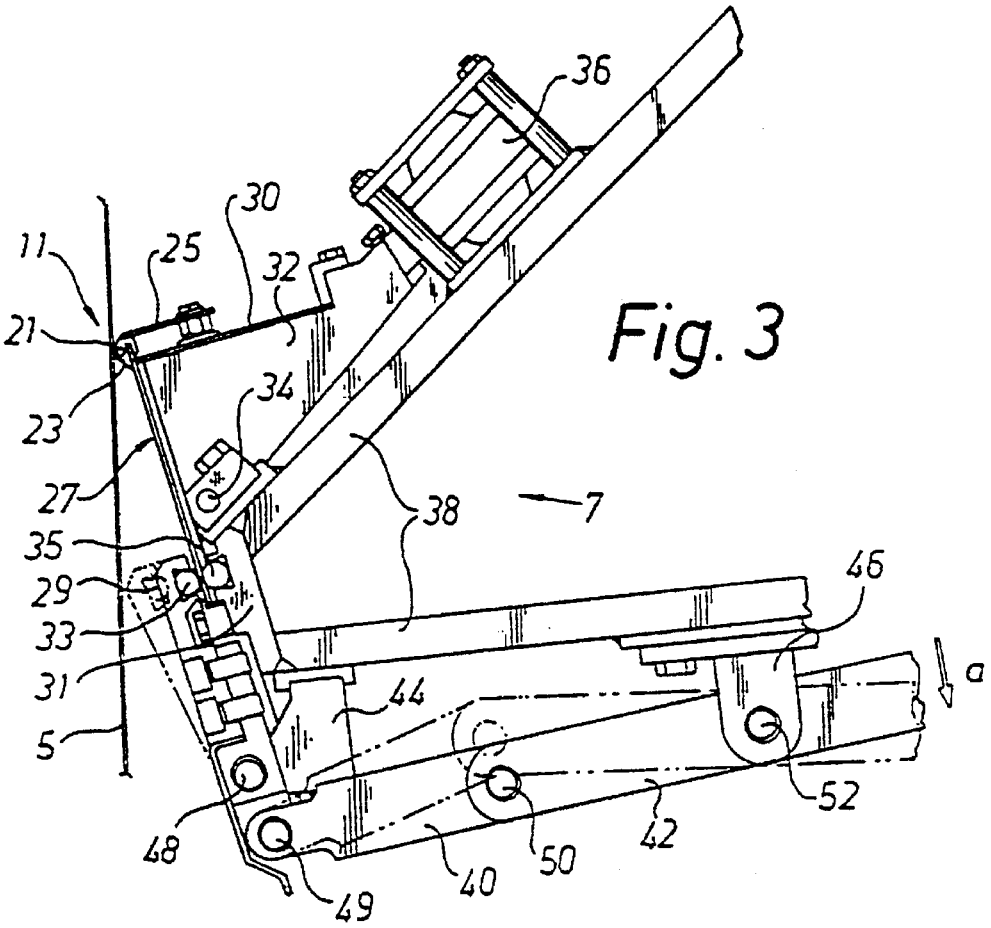
FIG. 3 shows diagramatically in a side-view an embodiment of the coating device in accordance with the present invention.

FIG. 3 shows more in detail a preferred embodiment of the metering device according to the present invention. The metering device generally designated 7 is shown in a side-view in connection to a paper web 5 travelling in a downward direction.

Figure 5:
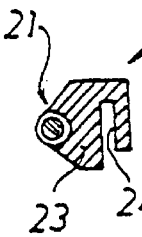
FIG. 5 shows in detail a cross-section through a metering member designed in accordance with the present invention.

The metering means proper generally designated 11 comprises in the embodiment shown a closely wound thread spiral 21 arranged in an undercut groove in a plastic profile 23, such as shown in detail in section in FIG. 5. Thread spiral 21 is thus forced into the undercut groove of the plastic profile 23, and in the embodiment shown about ⅓ of the circumference of thread spiral 21 is exposed for providing the desired metering function.

In the embodiment shown in FIG. 3 the metering means 11 thus contains a closely wound coil spring 21. The diameter of the wire used in coil spring 1 may vary but it is normally of the order of 1 mm or less, for example a few tenths of millimeters, such as lying within the range about 0.2 to about 0.5 mm.. The material of the coil spring is suitably constituted by steel or a steel alloy.

In feeding the metering means 11 is carried across the web 5 on a blade 27 extending across the full width of the paper web 5. The metering means 11 is slidably arranged on the free longside of blade 27 via the recess 24 of the plastic profile 23. The metering means 11 is maintained in position on blade 27 by means of springs 25 anchored to a pressure blade 30, the function of which is to be further explained below. The blade 27 is along its other longside anchored between jaws 29,31, wherein one jaw 29 is mobile, whereas the other jaw 31 is fixed and constitutes part of a supporting beam 38. The blade 27 is held between the jaws 29, 31 between opposite members 33,35, one of which is constituted by a round steel bar 35, whereas the other is constituted by a rubber profile 33, whereby both sealing and mobile clamping of the blade 27 will be provided. The mobile jaw 29 is pivotably connected to a lever 40 via a pivot 49 and can be rotated around a pivot 48 which via an attachment member 44 is connected to the lower side of the supporting beam 38. At its opposite end a lever 40 is pivotably connected to a second lever 42 which is pivotable around a pivot 52 connected to the lower side of supporting beam 38 via a second attachment member 46. The two pivots 40,42 are pivotably connected to each other through a pivot 50, and the outer end of lever 42 can, by suitable pneumatic or hydraulic means (not shown), be moved from the position shown in FIG. 3 with full lines to the position shown by dotted lines, which means that the mobile jaw 29 in turn moves to the position shown in FIG. 3 by dotted lines to release blade 27.

On the upper side of supporting beam 38 levers 32 are arranged at regular intervals, said levers being pivotably journalled in pivots 34. The longitudinally extending pressure blade 33 extends cross-wise over the separate levers 32 and exert along its front edge a pressure against blade 27 adjacent to the metering means 11 over its entire length, i.e. over the full breath of the web. For each lever 32 an individual pneumatic pressure member 36 is arranged, whereby the load on metering means 11 can be adjusted both uniformly across the full width of the web and zone-wise to the desired pressure profile. With regard to the principle of this arrangement reference is made to Swedish patent 9102783-9 where the device in this regard is described in detail.

Figure 4:
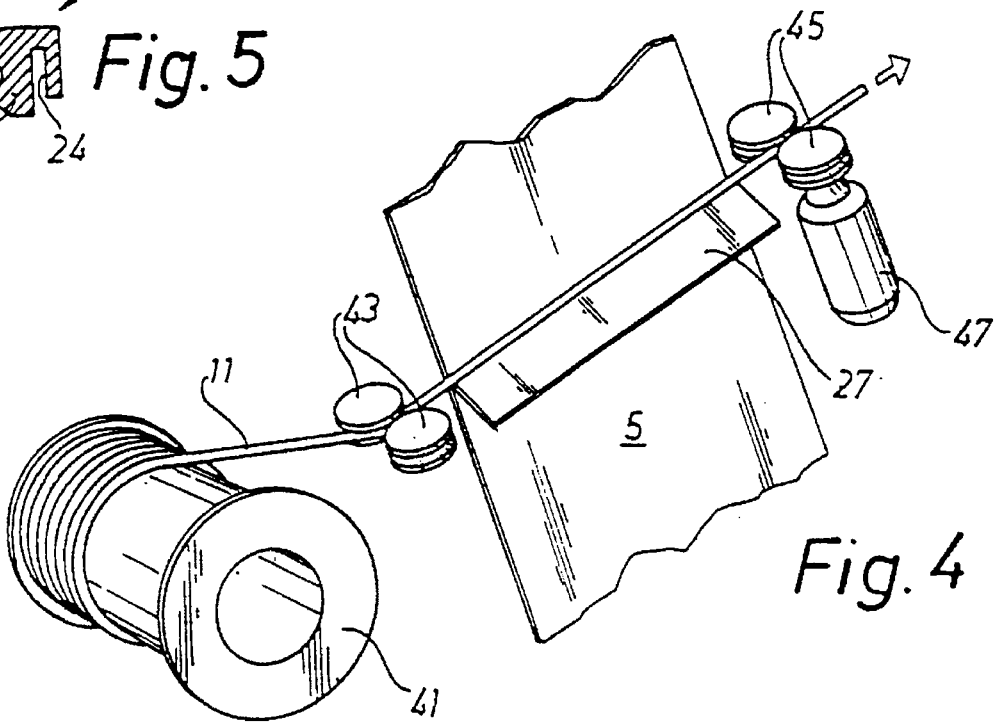
FIG. 4 shows diagramatically an arrangement for feeding the metering member across a travelling web.

FIG. 4 shows diagramatically an arrangement for feeding the metering means 11 in the embodiment shown and initially wound onto a supply roll 41. Via guide rollers 43 metering means 11 is transferred to the blade 27 fuctioning as a guide in the feeding of the metering means 11. This feeding takes place by means of feeding wheels 45, driven for example by means of a motor 47. In connection with the feeding of the dosing means 11 along blade 27 for providing metering of coating agent feeding means 11 is properly disposed of, for example by winding or severing.

In an alternative embodiment of the arrangment according to FIG. 4 metering means 11 can be wound onto another roll similar to the supply roll 41, and after emptying the supply roll 41 the feeding direction can be reverted, so that metering means 11 is fed back onto supply roll 41.

As is clear from FIGS. 1 and 2 the metering means 11 is supplied with coating agent via application conduits, 15, and in view of the design of the metering means with the closely wound coil spring 21 a balanced dosage of coating agent is supplied onto the transfer roller 3 for transfer to the travelling paper web 5. By means of the individual pneumatic pressure members 36 the metering means 11 can be brought to engagement against the paper web 5 at the desired pressure, either uniformly across the full width of the web or individually zone-wise.

For so called direct coating with the metering means operating directly on the paper web the closely wound coil spring 21 can be replaced with a smooth wire, which either cotravels with the plastic profile 23 or travels in the first recess of the plastic profile 23, the plastic profile 23 being stationary arranged on blade 27. For the purpose of further extending the life time of the metering means 11 the coating device can be easily provided with suitable means for step-wise or continuous rotation of coil spring 21, so that new parts thereof as seen in a circumferential direction are brought to engagement on the paper web. Such rotation of the coil spring 21 can be easily obtained using a chuck-like device engaging the coil spring 21 for a short moment and turning same in its anchorage in plastic profile 23, and this can be repeated at regular intervals so as to obtain even wear of the coil spring 21. Such chuck-like device can be easily synchronized to the feeding speed of the metering means 11.

It may be added that metering means 11 also can be arranged in the form of an endless loop fed in one direction, optionally under step-wise or continuous rotation to provide even wear. In this manner the operating time can be substantially extended and the costs arising in shutdowns substantially reduced.

The present invention is not restricted to the embodiments described above. It can be applied on any occasion where it is desired to supply to one or both sides of a travelling web a desired material, for example coating liquid/paste, size material or other desired material for modification of for example the properties or appearance of the paper. In all embodiments described the closely wound coil can be replaced with a wire-like element provided with turned or milled grooves which can run parallel around the wire perpendicular to a theoretic center line through same or can run in a spiral in the corresponding manner as the wires of the closely wound coil spring. Such milled or turned grooves can have cross-sections of varying shape, all from square or rectangular cross-sections to rounded cross-sections. The dimensions of these cross-sections largely correspond to the dimension of the wire from which coil spring 21 is built up.

I claim:

1. Coating device for one- or two-sided coating of a travelling web, the coating device comprising:

at least one counter-means disposed on one side of the web;

at least one first metering means disposed on an opposite side of the web, the metering means including a transfer roller and a metering member, the transfer roller and the metering member extending across the web over a full width of the web, the metering member being made of a flexible, elongate element, a length of said element substantially exceeding the width of the web, said element being arranged to be fed across the web so that new sections of said element contact with the web to ensure correct metering of a supplied coating agent, said element having a contact surface, the contact surface being provided with one or more grooves for being supplied with coating agent for metered application of coating agent onto a surface of the transfer roller at a point on the transfer roller upstream of a point of contact of the transfer roller with the web.

2. Coating device according to claim 1, the metering means further comprising a fixed supporting means extending across the full width of the web, the elongate element being slidable relative to the web along a side of the supporting means.

3. Coating device according to claim 1, wherein the elongate element includes a coextensive supporting profiled member, the profiled member having a first longitudinal recess, and an engaging element, the engaging element being disposed in the first longitudinal recess of the profiled member.

4. Coating device according to claim 3, the metering means further comprising a fixed supporting means extending across the full width of the web, the elongate element being slidable relative to the web along a side of the supporting means, and wherein the profiled member includes a second longitudinal recess, the side of the supporting means being accommodated in the second longitudinal recess.

5. Coating device according to claim 4, wherein said supporting means includes a blade, the metering means further including a blade holder, the blade holder holding the supporting means along a second side of the supporting means.

6. Coating device according to claim 5, wherein the blade holder includes a fixed jaw and a movable counter-jaw, and the blade is movably clamped between said fixed jaw and said counter-jaw.

7. Coating device according to claim 6, wherein that one jaw includes a resilient sealing member permitting sealing toward the coating agent and movability of the blade.

8. Coating device according to claim 5, wherein said metering means further includes pressure means arranged to urge the profiled member toward the transfer roller.

9. Coating device according to claim 8, wherein said pressure means includes a pressure blade coextensive with the blade, said pressure blade forming an angle relative to the blade and being arranged such that one longitudinal edge thereof exerts a pressure along the side of the blade.

10. Coating device according to claim 9, wherein more than one of said pressure means is distributed along a length of the blade for exerting pressure at a corresponding number of positions along the side of the blade.

11. Coating device according to claim 4, wherein the elongate element has a circular cross-section.

12. Coating device according to claim 4, wherein the elongate element is in the form of a closely wound helix.

13. Coating device according to claim 4, wherein said metering means includes one or more supply rolls from which the elongate element is unwound and onto which the elongate element is wound.

14. Coating device according to claim 1, wherein the elongate element is rotatable.

15. Coating device according to claim 4, wherein said elongate element includes an elongate thread.

16. Coating device according to claim 2, wherein the elongate element includes a coextensive supporting profiled member, the profiled member having a first longitudinal recess, and an engaging element, the engaging element being disposed in the first longitudinal recess of the profiled member.

17. Coating device according to claim 2, wherein said supporting means includes a blade, the metering means further including a blade, the blade holder holding the supporting member along a second side of the supporting means.

18. Coating device according to claim 6, wherein said metering means further includes pressure means arranged to urge the profiled member toward the transfer roller.

19. Coating device according to claim 7, wherein said metering means further includes pressure means arranged to urge the profiled member toward the transfer roller.

* * * * *